US005593009A

United States Patent [19]

King

[11] Patent Number: 5,593,009

[45] Date of Patent: Jan. 14, 1997

[54] RETRACTABLE AUXILIARY LUGGAGE ATTACHMENT MECHANISM AND METHOD

[75] Inventor: William L. King, Denver, Colo.

[73] Assignee: Samsonite Corporation, Denver, Colo.

[21] Appl. No.: 562,230

[22] Filed: Nov. 21, 1995

Related U.S. Application Data

[63] Continuation of Ser. No. 182,406, Jan. 18, 1994, abandoned.

[51] Int. Cl.[6] ..... A45C 5/14; A45C 13/30; A45C 13/38

[52] U.S. Cl. ..... 190/102; 190/18 A; 190/39; 190/108; 190/115; 24/69 CT; 24/369; 248/308

[58] Field of Search ..... 190/18 A, 102, 190/115, 24, 15.1, 39, 108; 24/29, 68 CT, 69 CT, 369; 248/308, 339, 914

[56] References Cited

U.S. PATENT DOCUMENTS

| | | | |
|---|---|---|---|
| 259,671 | 6/1882 | Dean | 24/695 |
| 512,772 | 1/1894 | Ward | 294/154 X |
| 618,598 | 1/1899 | Cameron et al. | 190/27 |
| 672,173 | 4/1901 | Lefevre . | |
| 699,790 | 5/1902 | Collins | 190/27 |
| 910,238 | 1/1909 | Shaw . | |
| 1,011,326 | 12/1911 | Deal | 190/27 |
| 1,084,360 | 1/1914 | Rahm . | |
| 1,916,793 | 7/1933 | Harper . | |
| 2,372,845 | 4/1945 | Nelson . | |
| 2,500,471 | 3/1950 | Schmiedt | 24/369 X |
| 2,581,417 | 1/1952 | Jones . | |
| 2,631,803 | 3/1953 | Meyers | 248/914 X |
| 2,707,035 | 4/1955 | Lashley . | |
| 2,901,204 | 8/1959 | Davis | 248/305 X |
| 3,518,791 | 7/1970 | Carlson et al. | 248/239 X |
| 3,564,590 | 2/1971 | Hebel . | |
| 3,606,372 | 9/1971 | Browning . | |
| 3,958,731 | 5/1976 | Riedle . | |
| 4,112,542 | 9/1978 | Snyder | 190/108 X |
| 4,383,141 | 5/1983 | Walker . | |
| 4,538,709 | 9/1985 | Williams et al. | 206/287.1 X |
| 4,621,404 | 11/1986 | Browning . | |
| 4,738,341 | 4/1988 | Asano | 190/102 X |
| 4,759,431 | 7/1988 | King et al. . | |
| 4,887,700 | 12/1989 | Rice | 190/111 |
| 4,978,093 | 12/1990 | Kennedy | 248/914 X |
| 4,995,487 | 2/1991 | Plath . | |
| 5,103,975 | 4/1992 | Liu | 190/115 X |
| 5,108,119 | 4/1992 | Huang . | |
| 5,253,739 | 10/1993 | King . | |
| 5,291,976 | 3/1994 | Ku | 190/39 X |
| 5,355,980 | 10/1994 | Hsieh | 190/18 A |

FOREIGN PATENT DOCUMENTS

| | | | |
|---|---|---|---|
| 79203 | 11/1919 | Austria | 24/69 CT |
| 2441358 | 6/1980 | France . | |
| 28543 | 12/1989 | United Kingdom | 190/27 |
| 9319636 | 10/1993 | WIPO . | |

*Primary Examiner*—Sue A. Weaver
*Attorney, Agent, or Firm*—Lee R. Osman; Rod D. Baker

[57] ABSTRACT

An attachment mechanism for an auxiliary luggage case which is attached to a main luggage case to attach an auxiliary luggage case for support on and by an exterior surface of the main luggage case. The attachment mechanism includes a flexible elongated belt member connected to the main luggage case, a hook member connected to an outer end of the belt member, and a pocket having a size sufficient to contain the hook and the belt member. A selectively openable and closeable cover member allows access to the pocket to remove and extend the belt member and the hook member, and also restricts access to the pocket and fully confines the retracted belt member and hook member within the pocket. The hook member is preferably pivotal to an extended position in which to attach to luggage and to a retracted position which consumes less space than in the extended position. The hook member may be adjustably positioned along the length of the belt when in the retracted position and is fixed to the selected location on the belt when in the extended position.

16 Claims, 5 Drawing Sheets

RETRACTABLE AUXILIARY LUGGAGE ATTACHMENT MECHANISM AND METHOD

RELATED APPLICATIONS

This is a continuation of application Ser. No. 08/182,406 filed Jan. 18, 1994, now abandoned.

This invention relates to attaching an auxiliary luggage case to a main luggage case, and more particularly to a new and improved auxiliary luggage case attachment mechanism and method which may be employed independently of other apparatus and methodology for attaching the auxiliary luggage case to be transported with the main luggage case.

BACKGROUND OF THE INVENTION

Luggage of the type adapted to contain articles of clothing, personal items and the like, has traditionally been transported by lifting the luggage by a carrying handle. More recently, however, particularly with larger pieces of luggage or those adapted to carry heavy articles, wheels have been mounted on the luggage and an auxiliary handle or tether has been used to push or pull the luggage on its wheels. This type of wheeled luggage has met with considerable acceptance, because greater weights can be transported with relative ease. To further take advantage of the conveniences of wheeled luggage, devices have been developed for attaching auxiliary luggage cases to the wheeled main luggage case to allow several luggage cases to be transported simultaneously.

Initially, the devices for carrying the auxiliary luggage case used fixed-length straps or expandable straps that were wrapped around the auxiliary luggage case as well as a portion of the wheeled luggage case to secure the two luggage cases together. These straps, however, were typically not connected to the wheeled luggage case. The potential for misplacing the strap, the inconvenience of having to separately store the strap, the risk of loss of the strap and the improper length of the strap to adequately attach the auxiliary luggage case were all factors which discouraged use of these removable straps.

Removable devices attached to the main luggage case, such as straps or hooks, have also been used for attaching auxiliary luggage cases to a main luggage case. However, removable devices have also failed to satisfy users. Storing the removable device in the main luggage case was an inconvenience because the device consumed valuable packing space and was sometimes difficult to access when the main case was packed. Removing and storing the device elsewhere created an inconvenience because access to it was limited, and the device could easily be misplaced.

Devices permanently attached to a main luggage case for carrying auxiliary luggage have also presented issues of convenience of use. When the permanent attachment devices are not being used to attach an auxiliary luggage case, they often project from the case and pose the risk of becoming broken, snagged or otherwise caught on other articles. The permanent nature of the attachment devices on the main luggage case can also make the case difficult to store.

Efforts to devise a wheeled main luggage case with the ability to carry an auxiliary luggage case have resulted in attachment devices that depend from an extendable pull handle on the main luggage case. An example of one of these devices is disclosed in U.S. Pat. No. 4,759,431, assigned to the assignee hereof. These devices are retractable in conjunction with the retraction of the handle, so an auxiliary luggage case can only be attached and carried when the pull handle is extended from the main luggage case. Under some circumstances it may be desirable not to extend the pull handle or to roll the main luggage case on its wheels in order to use the auxiliary luggage attaching capability.

The auxiliary case attachment devices frequently employ hooks to hold the handle of the auxiliary case. Hooks, however, can also be difficult to store because of the size and shape of their rigid structures. Recesses in which to place the hooks when not in use must be of a significant size to accommodate the hook. The size of such recesses may consume otherwise useable packing space within the luggage case. If the hook is not stored in a recess, some other type of structure associated with the case must be provided in order to accommodate the hook when it is not in use.

It is with respect to these considerations and other background information relative to prior art auxiliary luggage attachment mechanisms that the significant improvements of the present invention have evolved.

SUMMARY OF THE INVENTION

One of the important aspects of the present invention relates to an attachment mechanism for an auxiliary luggage case which is permanently attached to a main luggage case to avoid problems of misplacing or losing it, which is retractable when not in use to avoid problems of inconvenience, breakage, exposure and the like, which is extendable to the degree desirable to accommodate a variety of different types and sizes of auxiliary luggage, and which is available for use independent of the other functionality of pull handles and the like of the main luggage case.

In accordance with these and other aspects, the present invention relates to a new and improved mechanism for attaching an auxiliary luggage case to a main luggage case is adapted to attach an auxiliary luggage case for support on and by an exterior surface of a main luggage case having wheels. The attachment mechanism functions independently of the extension or retraction of a maneuvering handle of the main luggage case. The attachment mechanism includes a flexible elongated belt member connected to the main luggage case, a hook member connected to an outer end of the belt member, and a pocket having a size sufficient to contain the hook and the belt member. A selectively openable and closeable cover member allows access to the pocket to remove and extend the belt member and the hook member, and also restricts access to the pocket and fully confines the retracted belt member and hook member within the pocket. The hook member may be adjustably positioned along the length of the belt. The cover member may be a flap formed in the exterior panel of a soft-sided luggage case or a separate moveable rigid member in the exterior surface of a hard-sided luggage case.

In accordance with other aspects, the present invention also relates to a new and improved method of attaching the auxiliary luggage case for support on and by the exterior surface of the main luggage case. The method involves attaching an end of a flexible elongated belt member to the main luggage case, and connecting a hook member to an outer end of the belt member. A pocket is formed with a size sufficient to contain the hook and the belt member, and the belt member and the hook member is placed in the pocket when not in use for attaching an auxiliary luggage case for support on the main luggage case. The hook member and the belt member are retained in the pocket when not in use by closing a cover member over the pocket. The belt member is extended from the pocket when in use for attaching an auxiliary luggage case with the hook member connected to the auxiliary luggage case.

In accordance with other important aspects of the present invention, a new and improved foldable hook is pivotal to an extended position in which to attach to luggage and to a retracted position which consumes less space than in the extended position. The hook comprises a main portion and an extendable portion. A hinge structure pivotally connects the main and extendable portions to pivot with respect to one another between the extended and retracted positions. Contact surfaces are located on the hinged ends of the main and extendable portions at locations to contact one another to prevent further pivoting in the extended position and to establish a predetermined fixed angle of the extendable portion relative to the main portion in the extended position. In the extended position, the operative contact of the contact surfaces resists the force from the auxiliary luggage and fixes the position of the hook along the length of the belt by contact of the contact surfaces on opposite sides of the belt. In the retracted position, the extendable and main portions are positioned substantially adjacent to one another, and the cam surfaces separate from one another a sufficient amount to release the contact on the belt and to allow the position of the hook to be selectively positioned along the belt.

A more complete appreciation of the present invention and its scope can be obtained from the accompanying drawings, which are briefly summarized below, the following detailed description of presently preferred embodiments of the invention, and the appended claims.

DETAILED DESCRIPTION

Figure 1:
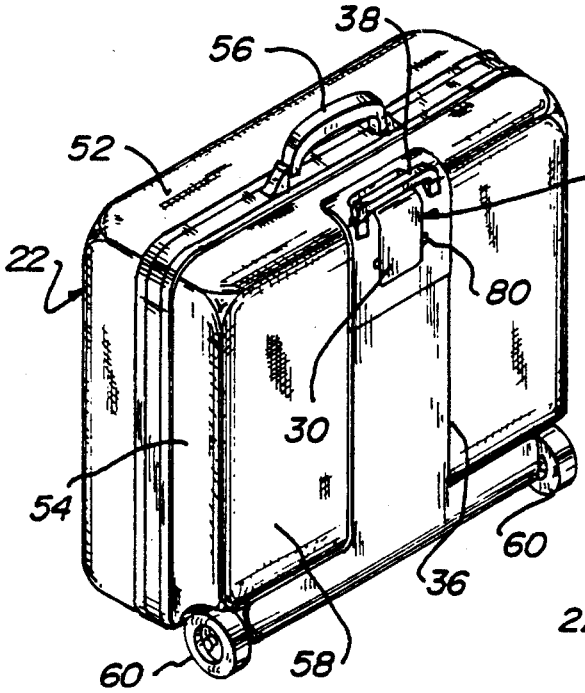
FIG. 1 is a perspective view of a wheeled luggage case having an auxiliary case attachment mechanism incorporating the present invention, shown with the attachment mechanism not in use.

An auxiliary luggage case attachment mechanism 20, which embodies one form of the present invention, is connected to a main luggage case 22, as shown in FIGS. 1–4. The attachment mechanism 20 includes a strap 24, a hook 26, a pocket 28 and a cover 30. The hook 26 and the strap 24 are retractable into the pocket 28 when an auxiliary luggage case 32 (FIG. 5) is not attached to the main luggage case 22. When in the retracted position shown in FIGS. 1 and 2, the hook 26 is folded to reduce its size to facilitate its convenient storage in the pocket 28. In the retracted position the cover 30 is able to be closed over the pocket.

Figure 3:
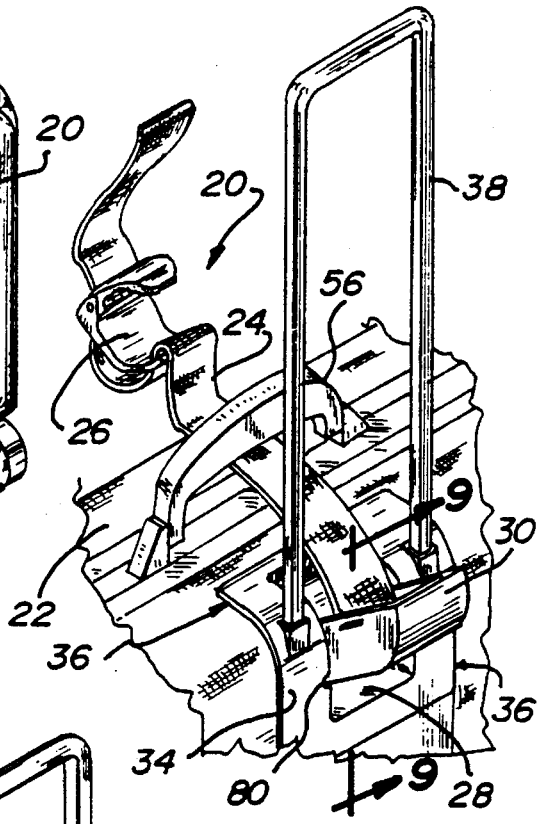
FIG. 3 is a partial perspective view similar to FIG. 2, illustrating a strap, a hook, a pocket and a cover of the attachment mechanism, with the strap and hook in an extended position but not holding an auxiliary luggage case and with the cover open.
Figure 4:
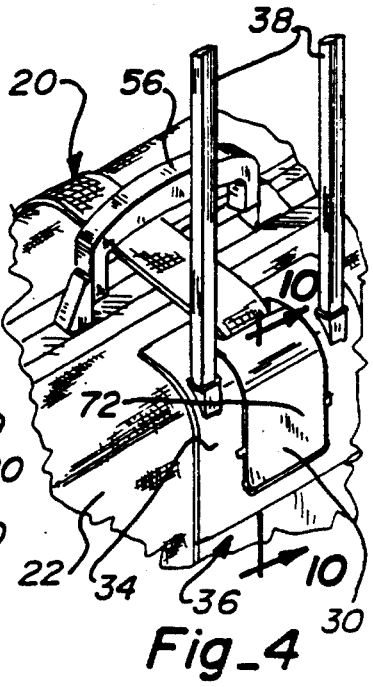
FIG. 4 is a partial perspective view similar to FIG. 3, illustrating the strap and hook of the attachment mechanism in an extended position draped over the wheeled luggage case in a position for carrying auxiliary luggage and with the cover closed over the pocket.
Figure 5:
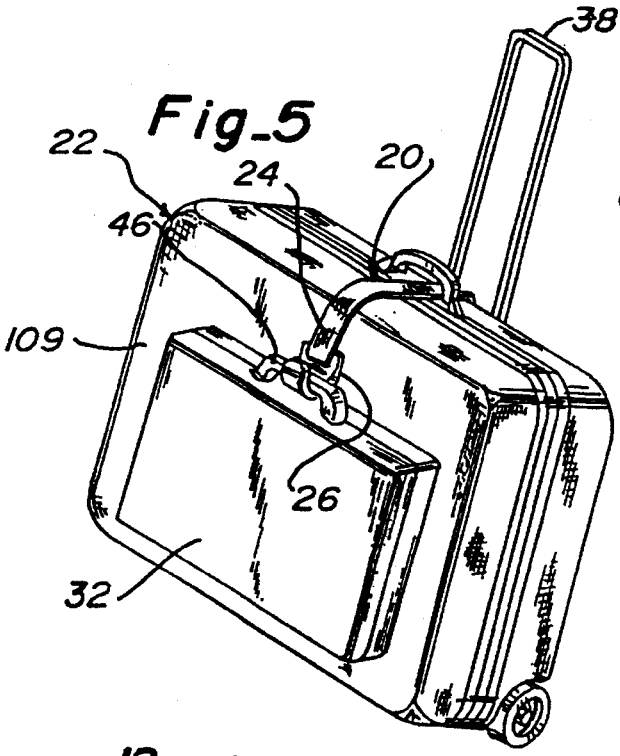
FIG. 5 is a view of the wheeled luggage case shown in FIG. 1 from a perspective illustrating the attachment mechanism supporting an auxiliary luggage case.
Figure 16:
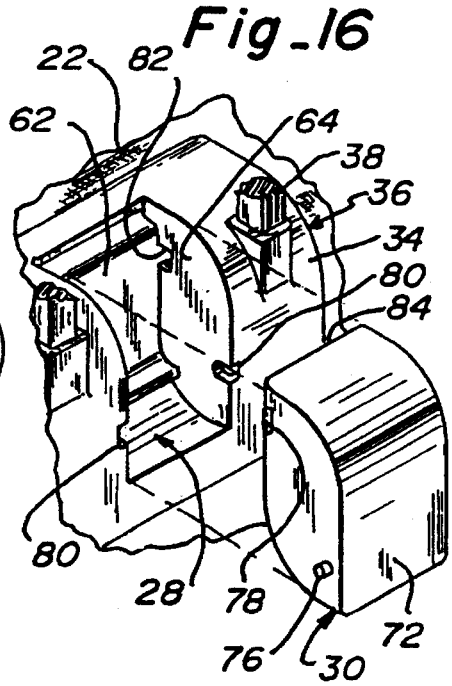
FIG. 16 is an exploded view of the cover and the pocket of the attachment mechanism shown in FIGS. 8, 9, 10 and 11.

In the extended position shown in FIGS. 3, 4, and 5, the strap 24 and hook 26 extend out of the pocket 28 to secure an auxiliary luggage case. The hook 26 may be adjusted in position along the length of the strap 24 to securely attach any of a variety of sizes of an auxiliary luggage case 32 to the main luggage case 22. The cover 30 may be closed flush with an external surface 34 of a cassette 36 of the main luggage case 22. The cassette 36 is a structure by which the attachment mechanism 20 and a pull handle 38 are preferably connected to the main luggage case 22.

Figure 6:
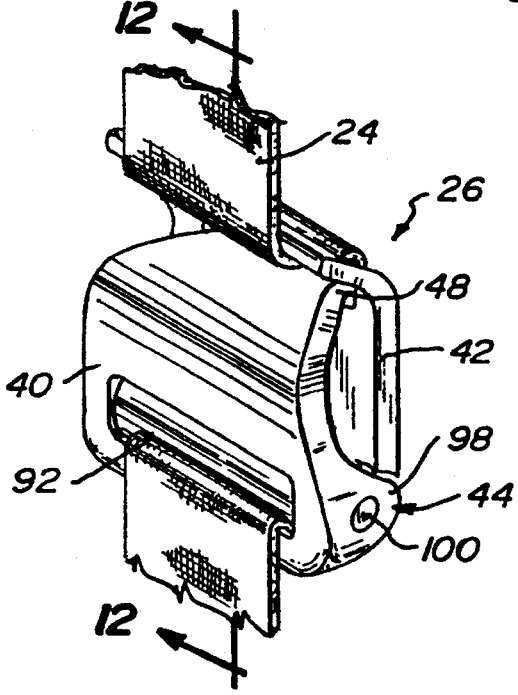
FIG. 6 is an enlarged perspective view of a foldable hook of the attachment mechanism attached to the strap as shown in FIG. 3, illustrating the foldable hook in a folded position.
Figure 7:
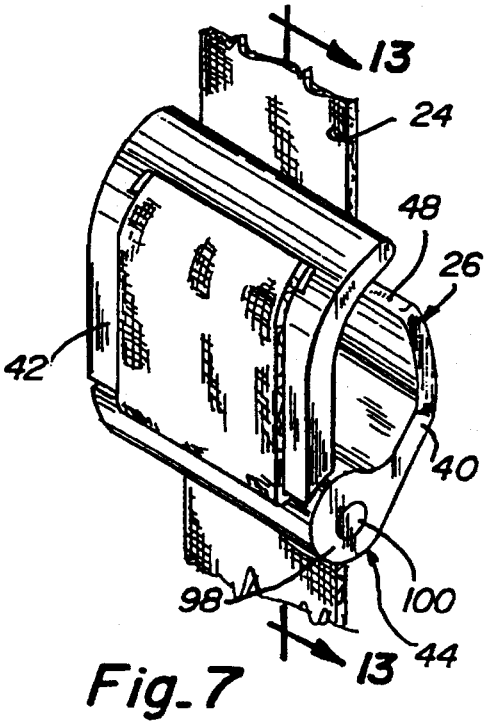
FIG. 7 is a perspective view of the foldable hook as shown in FIG. 6, illustrating an unfolded position.

The hook 26 comprises a first extendable portion 40 and a second main portion 42 which are pivotally connected together by a hinge structure 44 integrally formed in each portion 40 and 42, as shown in FIGS. 6 and 7. In the unfolded position shown in FIG. 7, the hook has a general "J" shape conducive to supporting, for instance, a handle 46 (FIG. 5) of the auxiliary luggage case 32. The hinge structure 44 permits the extendable hook portion 40 to pivot to a folded position which is substantially adjacent to the main hook portion 42, as shown in FIG. 6, and thereby allows the hook to consume less space when placed within the pocket 28.

Figure 8:
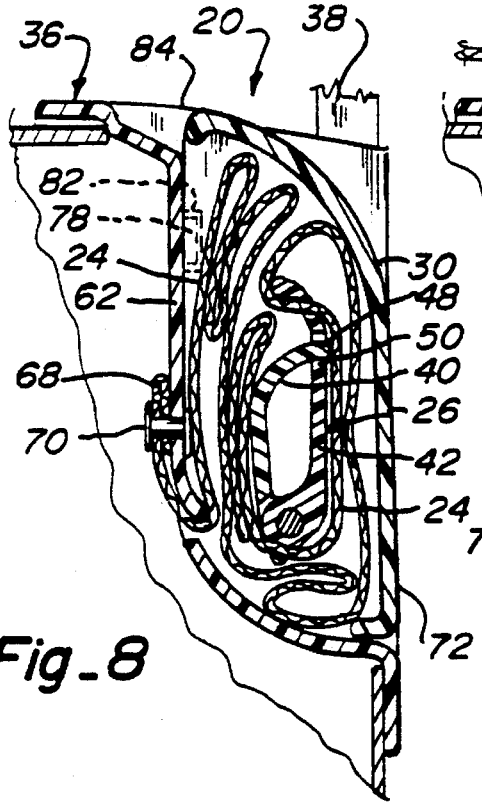
FIG. 8 is a section view of the attachment mechanism taken substantially in the plane of line 8—8 of FIG. 2, illustrating the foldable hook in the folded position, the strap in the retracted position wrapped around the folded hook in the pocket, and the cover closed.
Figure 9:
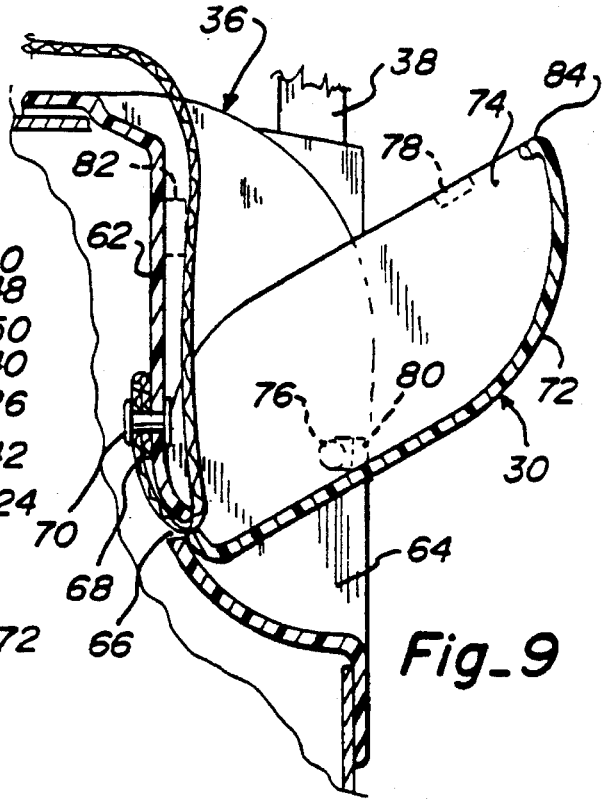
FIG. 9 is a section view of the attachment mechanism taken substantially in the plane of line 9—9 of FIG. 3, illustrating the strap in its extended position and the cover open.
Figure 10:
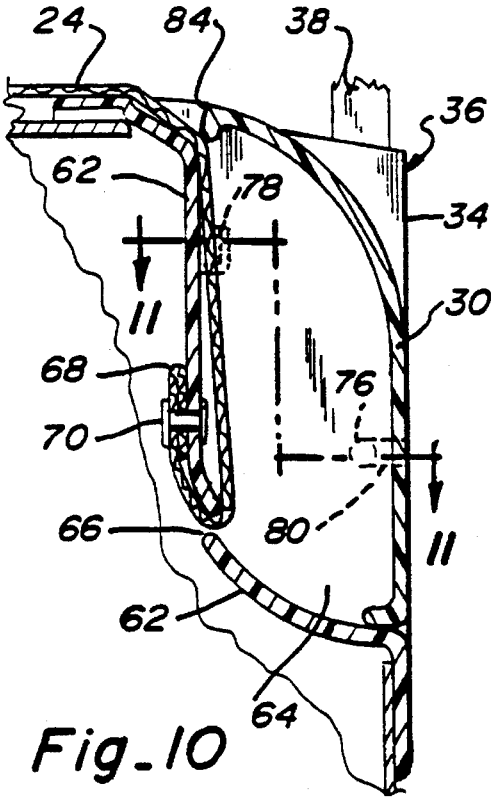
FIG. 10 is a section view of the attachment mechanism taken substantially in the plane of line 10—10 of FIG. 4, illustrating the strap in its extended position and the cover closed.
Figure 12:
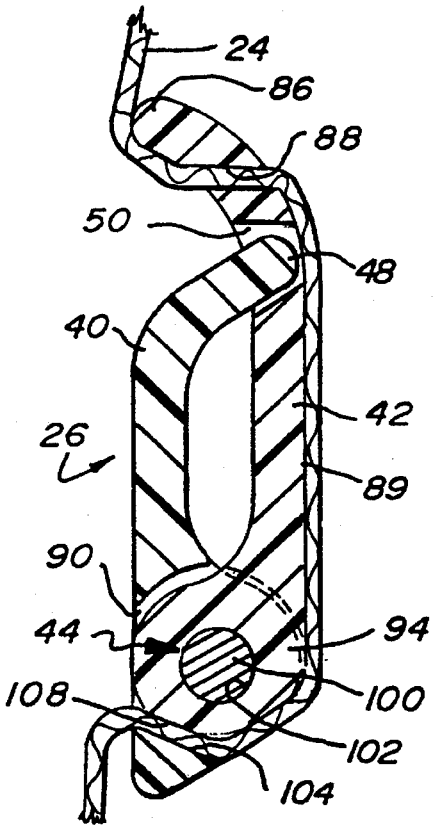
FIG. 12 is a section view taken substantially in the plane of line 12—12 of FIG. 6.
Figure 15:
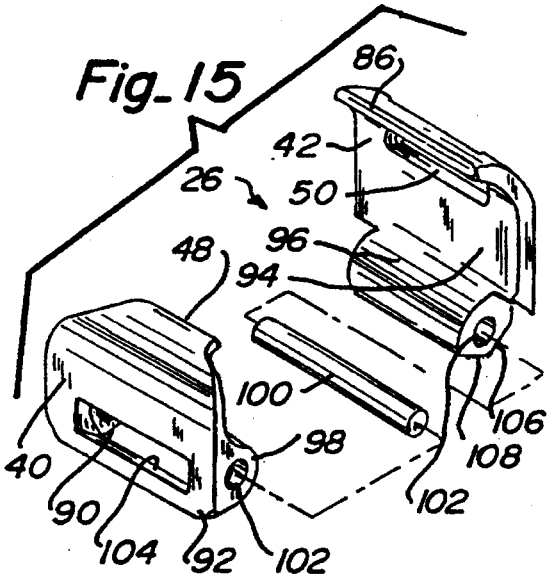
FIG. 15 is an exploded view of the foldable hook and the hinge structure shown in FIGS. 12–14.

When storing the hook 26 in the pocket 28, the hook portions 40 and 42 are pivoted toward each other about the hinge structure 44 so that an outer free end 48 of the extendable hook portion 40 fits into a groove 50 of the main hook portion 42, as shown in FIGS. 6, 8 and 12. When in the folded position, the hook 26 is permitted to be adjusted in position along the length of the strap 24, but in the unfolded position, the hook 26 is firmly positioned at a selected location along the length of the strap 24, as is discussed in greater detail below.

Figure 11:
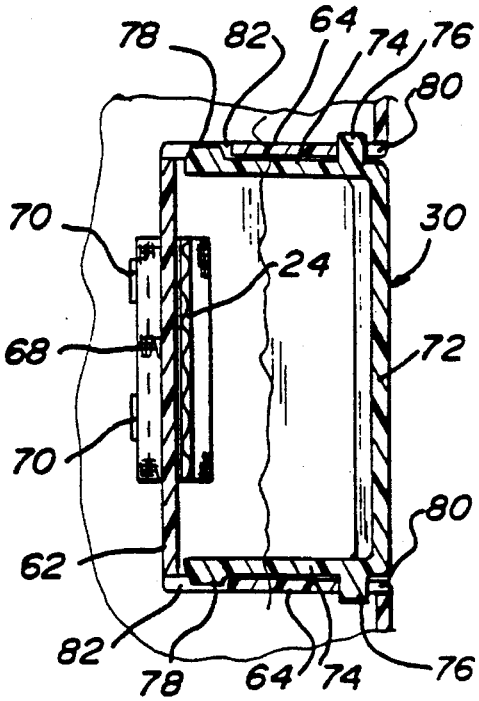
FIG. 11 is a section view taken substantially in the plane of line 11—11 of FIG. 10.

The pocket 28 is formed by a recess in the cassette 36, and the cover 30 is pivotally attached to the cassette to open and close the pocket 28, as shown in FIGS. 3, 8 and 11. The pocket 28 contains the strap 24 and the hook 26 when not being used to carry an auxiliary luggage case.

The luggage case 22 may either be a hard-sided or soft-sided suitcase. A hard-sided case is disclosed in FIG. 1 and is formed from two shell halves 52 and 54 which are hinged together in the conventional clam-shell like manner. A carrying handle 56 is attached to one of the shell halves 52 or 54 so that the luggage case 22 can be carried.

The cassette 36 is located along a major exterior surface 58 of the shell half 54, as shown in FIG. 1. The cassette 36 extends vertically down the surface 58 and continues laterally along a lower edge of the surface 58 parallel to the hinge point of the case halves 52 and 54. The cassette 36 fits into a similarly shaped depression formed in the case half 54 such that the exterior surface 34 of the cassette 36 is substantially flush with the surface 58 of the main luggage case 22.

Roller wheels 60 are rotatably mounted at lower lateral ends of the cassette 36, as shown in FIG. 1. The wheels 60 rest on a support surface and allow the case 22 to be pulled or maneuvered by the handle 38.

Figure 2:
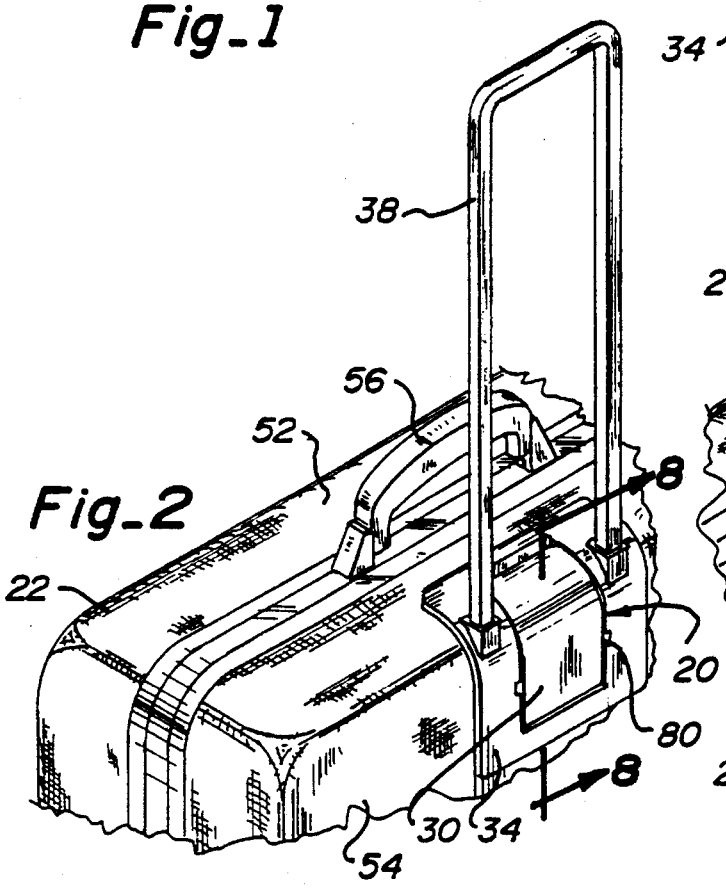
FIG. 2 is an enlarged partial perspective view of the wheeled luggage case shown in FIG. 1, with a pull handle extended from the wheeled luggage case.

The handle 38 is extendable from and retractable into the cassette 36 as seen in FIGS. 1 and 2. The handle 38, when extended, is used for pulling and maneuvering the luggage case 22 on its wheels 60, as shown in FIG. 5. The handle 38 is retractable substantially into the cassette 36 when not in use, as shown in FIG.

Details of the pocket 28 and cover 30 of the attachment mechanism 20 are shown in FIGS. 2, 3, 4, 9, 10, 11 and 16. Preferably, the pocket 28 is an integrally formed recess near the top of the cassette 36 between portions of the pull handle 38. The pocket 28 has a base wall 62 and two side walls 64, each perpendicular to the base wall. The base wall 62 has a slot 66 formed therein which extends laterally substantially between the side walls 64. The slot 66 receives a first or inner end 68 of the strap 24 to secure the strap to the cassette 36, which in turn is connected to the main luggage case 22. The inner end 68 of the strap is inserted through the slot 66 and connected to the base wall 62 by rivets 70, for example.

The cover 30 includes an outer wall 72 and two side walls 74, each of which extends perpendicular to the outer wall 72. Two laterally opposing pins 76 extend outwardly from the sidewalls 74 near the lower ends of the side walls 74. In addition, two laterally opposing tabs 78 extend outwardly from the side walls 74 at a position above the pins 76.

The side walls 68 of the pocket have formed therein a pair of laterally opposing grooves 80 for receiving the pins 76 of the cover. The grooves 80 are located near the junction of the side walls 74 and the external surface 34 of the cassette 36. The pocket side walls 64 have a pair of detents 82 located near the intersection of the side walls 64 and the base wall 62. The detents 82 receive the tabs 78 to releasibly secure the cover 30 in the closed position. The side walls 74 of the cover 30 fit inside and adjacent to the side walls 64 of the pocket 28. The pins 76 are pivotally received in the grooves 80. The tabs 78 are releasibly received in the detents 82, when the cover closes the pocket and the cover 30 is secured in the closed position. The cover 30 is opened by applying a small force at its upper end 84 to overcome the resistance of the tabs 78 in the detents 82 and to pivot the cover clockwise from the position shown in FIG. 8 to the position shown in FIG. 9. When the cover 30 is in the closed position, the pocket 28 and the cover 30 have an interior volume sufficient to store the retracted strap 24 and the hook 26 as shown in FIG. 8.

To conserve space within the attachment mechanism 20, or to allow the pocket 28 to be of a smaller size, the hook 26 is foldable, as shown in FIGS. 6 and 7. The hinge structure 44 permits the extendable portion 40 to fold substantially adjacent to the main portion 42, thereby allowing the two portions 40 and 42 to be located close to one another without consuming extra space as though the hook was in a rigid "J" shape.

Figure 13:
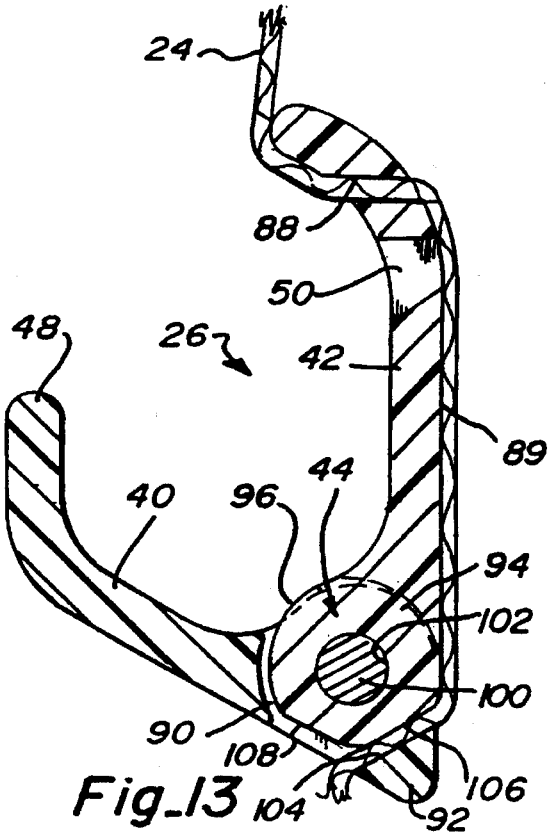
FIG. 13 is a section view similar to FIG. 12, illustrating the foldable hook in an unfolded position.

Referring to FIGS. 12 and 13, the main portion 42 of the hook 26 has an upper end 86 into which the groove 50 and a lateral slot 88 are formed. The lateral slot 88 receives the strap 24 passed therethrough. The strap 24 continues down a back side 89 of the main hook portion 42 and through a second lateral slot 90.

A hinged end 94 of the main hook portion 42 is formed with a laterally extending cylindrical barrel 96 as shown in FIGS. 12–15. The hinged end 92 of the extendable hook portion 40 comprises a pair of knuckles 98 separated by a distance substantially equal to the lateral dimension of the barrel 96. The barrel 96 fits between the knuckles 98 and a pivot pin 100 fits through an axially aligned bore 102 formed through the barrel 96 and knuckles 98 to form the hinge structure 44, thereby allowing the hook portions 40 and 42 to pivot or fold with respect to one another.

Figure 14:
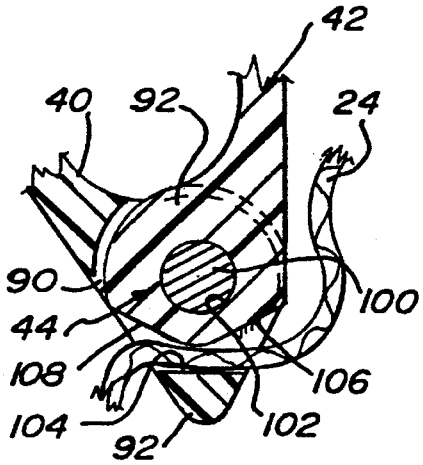
FIG. 14 is a partial section view illustrating a hinge structure of the foldable hook in a position between the folded and unfolded positions.

A flat cam surface 104 is formed laterally along a bottom edge of the slot 90 in the extendable hook portion 40, as shown in FIGS. 12, 13 and 14. A flat cam surface 106 extends laterally across the barrel 96 of the main portion 42. A second flat surface 108 is formed on the barrel 96 adjacent to the cam surface 106. The strap 24 extends over the surfaces 106 and 108, and between those surfaces and the surface 104.

When the hook portions 40 and 42 are folded together, the surfaces 104 and 108 face one another, as shown in FIG. 14. The distance between the surfaces 104 and 108 is greater than the thickness of the strap 24. Consequently, the hook 26 can be adjusted to any location on the strap 24 by sliding it along the strap when the hook is in the folded position, with the surfaces 104 and 108 facing one another. The strap 24 easily moves through slot 88 and the space between the surfaces 104 and 108 when the hook 26 is in the folded position.

To secure the hook 26 at a selected position on the strap, the hook must be unfolded. When the hook 26 is in the unfolded or extended position shown in FIG. 13, the cam surfaces 104 and 106 pinch the strap 24 securely therebetween. The relative distance between the cam surfaces 104 and 106 when the hook 26 is in the unfolded position is slightly less than the thickness of the strap 24 under conditions of maximum compressibility, so that the cam surfaces operatively contact one another via the thickness of the strap 24 trapped therebetween (FIG. 13). When the weight of the auxiliary luggage 32 is supported on the extendable hook portion 40 of the unfolded hook (FIG. 5), this weight further pinches the strap between the cam surfaces 104 and 106 to further restrain the hook against movement along the strap. The weight of the auxiliary case is thus used advantageously to restrain the hook in position on the strap.

To extend the strap 24 and hook 26 for use, the cover 30 is pivoted open and the strap and hook are removed from the pocket 28, as shown in FIGS. 3 and 5. The strap and hook 26 extend out of the pocket 28 and drape over the top of the luggage case 22, with the hook 24 hanging down a front panel 109 of the case as shown in FIG. 5. The position of the hook 28 on the strap 24 is then adjusted while the hook is in the folded position, as described above, to locate the hook at the appropriate location on the strap for carrying the particular auxiliary luggage case 32. The hook is then unfolded and is ready to receive the handle 46 of the auxiliary luggage case 32. The cover 30 can then be closed over the extended strap 26.

To store the hook 26 and strap 24 when not in use, the hook is folded, the strap is gathered up, and the strap and hook are then placed inside the pocket, as shown in FIG. 8. When the hook is folded for storage, the strap 24 can be wound around the folded hook, or the strap 24 can De inserted in accordion-like fashion into the pocket 28. The cover 30 is closed to confine the strap and hook within the pocket.

Figure 17:
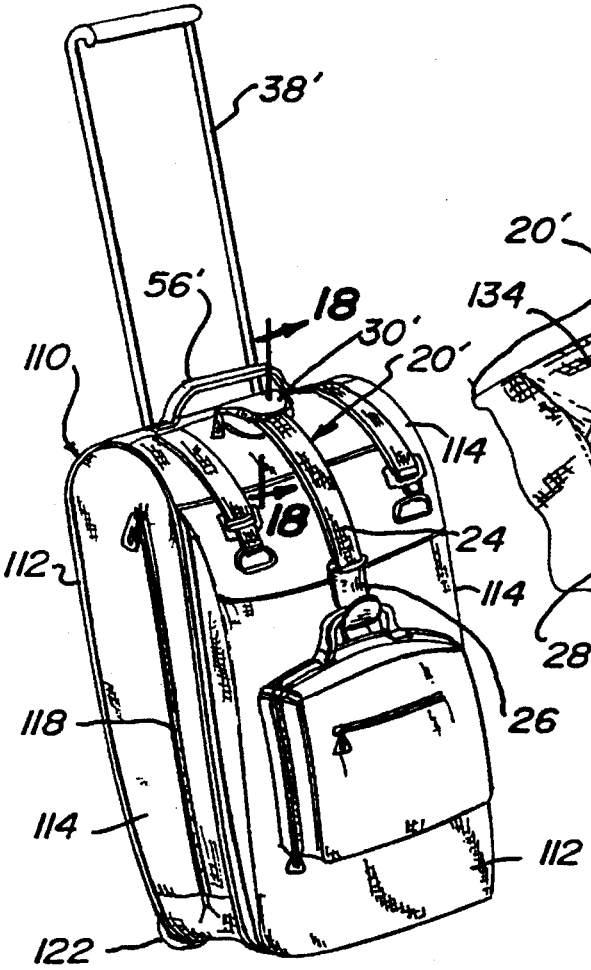
FIG. 17 is a perspective view of a wheeled soft-sided luggage case incorporating another embodiment of the present invention.
Figure 19:
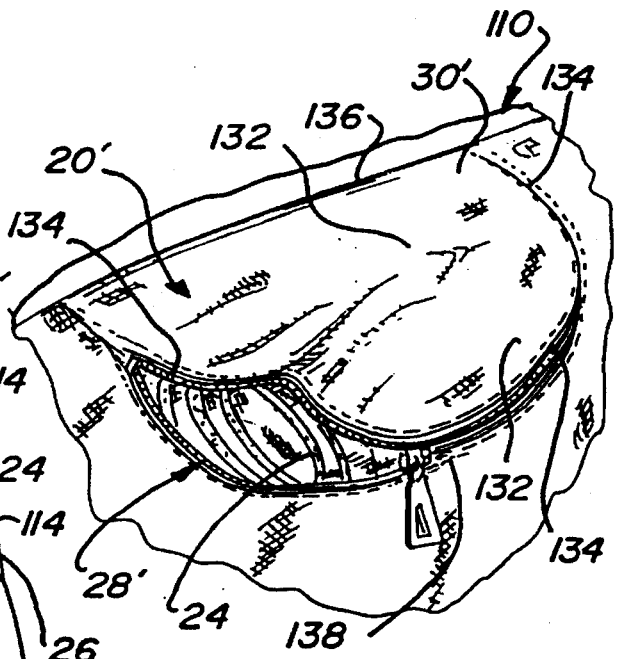
FIG. 19 is an enlarged perspective view of the attachment mechanism shown in FIG. 17, illustrating a hook and a strap within a pocket in the luggage case and a partially opened zippered cover for the pocket.
Figure 18:
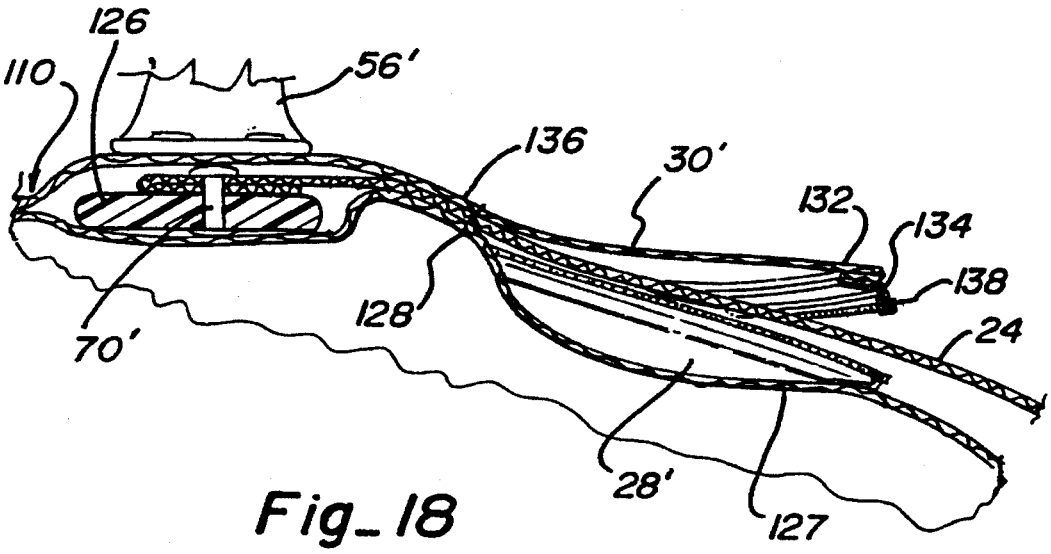
FIG. 18 is a partial enlarged section view taken substantially in the plane of line 18—18 of FIG. 17.

Another embodiment 20' of the attachment mechanism is shown in FIGS. 17–19. The attachment mechanism 20' is located near the top of a soft-sided luggage case 110. The soft-sided luggage case is generally formed with two major faces 112 and four side faces 114, each perpendicular to the major faces. The major faces 112 and side faces 114 enclose an interior cavity or volume suitable for carrying garments and personal articles. Access to the interior cavity is by a zipper opening 118, for example. A carry handle 56' is located at the center of the top side face 114, and is attached to an internal structural member 126 running laterally along the center of the top side face, as shown in FIG. 18. Wheels 122 are rotatably mounted at lower lateral sides of one of the major faces 112, and rest on a support surface. A pull handle 38' is extendable from and retractable into an internal structure behind the rear major face 112.

The attachment mechanism 20' comprises the strap 24', the hook 26', a pocket 28' and a cover 30'. The pocket 28' is formed of a fabric material 127 which is sewn or attached at 128, creating a pouch. A rear end of the strap 24' is inserted between the material 127 and the front major face panel 112 and extends to the frame member 126 where it is permanently attached by rivets 70', for example. The rear end of the strap is also attached at 128 between the face panel 112 and material 127.

The cover 30' is integrally formed with the material of the exterior front face 112. The cover 30' comprises a flap 132 separated from the material forming the front face 112 on three sides 134. A fourth side 136, where the flap 132 is integrally connected to the front face 112, acts as a living hinge allowing the cover 30' to either close over the pocket 28' or bend away from and expose the pocket 28'. A zipper 138 selectively connects the three sides 134 of the cover 30' to the front face 112 to close the pocket 28'. When the cover 30' is zipped closed over the pocket 28' the volume of the pocket 30' is sufficient to store the hook 26' and the strap 24'. When closed, the cover 30' is flush with the outer front face 112 of the soft sided luggage case 110.

To extend the strap 24' and the hook 26' for use, the zipper 138 is opened and the strap and hook are removed from the pocket 28'. The use of the strap 24' and hook 26' of the attachment mechanism 20' after this point is substantially the same as the use described in conjunction with the first embodiment 20 of the attachment mechanism.

To store the hook and strap when not in use, the hook 26' is folded, the strap 24' is gathered up, and the strap and hook are then placed inside the pouch-like pocket 28'. The cover 30' is then zipped closed using the zipper 138 to restrain the strap and hook in the pocket 28'.

Numerous advantages accrue as a result of using the attachment mechanism of the present invention. The problems associated with using straps or hooks separate from the wheeled luggage case, straps or hooks permanently attached to the exterior of the wheeled luggage case, or straps or hooks releasibly attached to the exterior of the wheeled luggage case are eliminated. The hook and strap are not able to be misplaced. The hook will not catch on other articles when not in use. The hook is foldable to reduce its size for efficient storage. The location of the hook on the strap is easily adjusted by folding the hook and sliding it along the strap to the desired location. The hook easily secured at any location on the strap by simply unfolding the hook. The hook may be advantageously used apart from the other aspects of the attachment mechanism. Many other significant advantages and improvements are apparent after comprehension of the improved features of the present invention.

Presently preferred embodiments of the present invention and many of its improvements have been described with a degree of particularity. The previous description is of preferred examples for implementing the invention, and the scope of the invention should not necessarily be limited by this description. The scope of the present invention is defined by the scope of the following claims.

The invention claimed is:

1. A foldable hook positionable along a strap fixed to a main luggage case, said hook being selectively foldable to a retracted position and selectively unfoldable to an extended position for receiving an element of an auxiliary luggage case, said strap having a thickness and said hook comprising:

a main portion having a first end and a second end;

an extendable portion having a first end and a second end;

a hinge structure pivotably connecting the respective first ends of the main portion and the extendable portion to pivot the main and extendable portions with respect to one another for selectively folding and unfolding the hook;

contact surfaces located on the respective first ends of the main portion and extendable portion, the contact surfaces operatively contacting one another to prevent further pivoting about the hinge structure when the main and extendable portions are unfolded to the extended position;

a slot between the contact surfaces on the respective first ends of the main portion and the extendable portion, said slot defined at least in part by the hinge structure;

wherein the contact surfaces are separated by a distance greater than the thickness of the strap when the main and extendable portions are folded to the retracted position, and are separated by a distance less than the thickness of the strap when the main and extendable portions are unfolded to the extended position, whereby the strap passes loosely through the slot between the contact surfaces when the main and extendable portions are folded to the retracted position and the contact surfaces pinch the strap when the main and extendable portions are unfolded to the extended position.

2. A foldable hook as defined in claim 1 wherein the hinge structure includes:

a cylindrical barrel fixed to the first end of the main portion, said cylindrical barrel having opposing ends, and said cylindrical barrel defining the contact surface on the first end of the main portion;

a pair of knuckles fixed to the first end of the extendable portion, said knuckles laterally spaced apart to receive therebetween the cylindrical barrel; and at least one pin extending between the barrel and each knuckle to pivotally connect the knuckles to the barrel.

3. A foldable hook in a movable position along the length of a strap and which is pivotable to an extended position in which to receive a luggage case and to a retracted position, said strap having a thickness between opposite sides and said hook comprising:

a main portion having a first end and a second end;

an extendable portion, engageable with a handle of the luggage case, and having a first end and a second end;

a hinge structure for pivotably connecting the first ends of the main portion and the extendable portion to pivot the main and extendable portions with respect to one another between the extended and retracted positions;

contact surfaces located on the first ends of the main portion and extendable portion, the contact surfaces operatively contacting one another to prevent further pivoting about the hinge structure when the main and extendable portions are in the extended position, and the contact surfaces being separated by a slot defined at least in part by the hinge structure when the main and extendable portions are folded to the retracted position;

wherein the main portion and the extendable portion define an acute angle when in the extended position and are substantially mutually parallel when in the retracted position, and wherein the contact surfaces are separated by a distance greater than the thickness of the strap when the main and extendable portions are folded to the retracted position, and are separated by a distance less than the thickness of the strap when the main and extendable portions are unfolded to the extended position, whereby the strap passes loosely between the contact surfaces when the main and extendable portions are folded to the retracted position, and the contact surfaces contact the opposite sides of the strap when the main and extendable portions are unfolded to the extended position.

4. A foldable hook as defined in claim 3 wherein the position of the hook along the length of the strap remains fixed by adjacent abutting contact of the contact surfaces on opposite sides of the strap when the hook is in the extended position and receives the luggage case.

5. A foldable hook as defined in claim 3 wherein the position of the hook along the length of the strap is selectively adjusted when the hook is in the retracted position with the contact surfaces separated from one another.

6. A foldable hook as defined in claim 3 wherein:

the main portion includes a groove; and the second end of the extendable portion fits within the groove when the main and extendable portions are folded to the retracted position.

7. An attachment mechanism connected to a main luggage case having a top surface and at least one adjoining exterior surface, said attachment mechanism adapted to support an auxiliary luggage case against the exterior surface to allow the auxiliary luggage case to be conveyed together with the main luggage case, said attachment mechanism comprising:

a flexible elongated strap having opposite sides separated by a thickness and an inner end fixed to the top surface of the main luggage case;

a hook member movably positioned upon the strap and adapted to receive a handle of the auxiliary luggage case, said hook member comprising:

a first portion comprising a first contact surface;

a second portion comprising a second contact surface;

means pivotably connecting the first and second portions to permit the contact surfaces to be pivoted toward each other to selectively fold the first and second portions together prior to retracting the hook member within the pocket, and to permit the contact surfaces to be pivoted away from each other to selectively unfold the first and second portions prior to the hook member receiving the handle of the auxiliary luggage case; and a slot between the first and second portions, defined at least in part by the means pivotably connecting the first and second portions;

a housing on the top surface of the main luggage case and defining a pocket dimensioned to at least partially contain the strap and the hook member, said strap and hook member being selectively extendable and retractable between an extended position outside the pocket and a retracted position within the pocket, the housing positioned on the main luggage case to locate said strap in the extended position to suspend the auxiliary luggage case from the hook member below the top surface and against the exterior surface of the main luggage case;

a cover member attached to the housing; and means for selectively closing the cover member over the pocket to maintain the retracted strap and hook member within the pocket and for selectively opening the cover member to allow the strap and hook member to be extended outside the pocket;

wherein the contact surfaces are separated by a distance less than the thickness of the strap when the first and second portions are unfolded, whereby the strap passes through the slot to allow the hook member to move along the strap when the first and second portions are selectively folded together, and the contact surfaces substantially pinch the strap from opposite sides of the strap to secure the hook member to the strap only when the first and second portions are unfolded to fix the hook member at a predetermined position along the strap.

8. An attachment mechanism as defined in claim 7 wherein the means for closing the cover member over the pocket is operative while the strap and hook member are extended outside the pocket to cover the pocket while the hook member supports the auxiliary luggage case.

9. An attachment mechanism as defined in claim 8 wherein the cover member conceals the strap and the hook member within the housing when the strap and hook member are retracted within the pocket and the cover member is selectively closed over the pocket.

10. An attachment mechanism as defined in claim 7 wherein the main luggage case is a hard-sided luggage case having a second surface separate from the exterior surface, and wherein the housing is recessed within the second surface of the main luggage case and the cover member is substantially flush with the second surface when the cover member is closed over the pocket.

11. An attachment mechanism as defined in claim 10 wherein:

the housing includes a rear wall, a bottom wall and opposing side walls which define the pocket; and the means for selectively closing and opening the cover member comprises:

opposing pins protruding from the cover member; and receptacles defined within the opposing side walls of the housing and adapted to pivotably receive the pins on the cover member.

12. An attachment mechanism as defined in claim 10 wherein the hard-sided luggage case includes wheels and a selectively extendable and retractable handle for maneuvering the hard-sided luggage case on the wheels, and wherein the cover member may be selectively opened and closed and the hook member and the strap may be selectively extended from and retracted within the pocket independently of the operation of the extendable and retractable handle.

13. An attachment mechanism as defined in claim 7 wherein the main luggage case is a soft-sided luggage case having a flexible panel, and wherein:

the cover member comprises a flap formed in the flexible panel; and the housing is recessed within the soft-sided luggage case beneath the flap.

14. An attachment mechanism as defined in claim 13 wherein the means for selectively closing and opening the cover member comprises a zipper operably selectively connecting the flap to the flexible panel.

15. An attachment mechanism as defined in claim 14 wherein the flap is flush with the flexible panel when the zipper connects the flap to the flexible panel.

16. An attachment mechanism as defined in claim 13 wherein the soft-sided luggage case includes wheels and a selectively extendable and retractable handle for maneuvering the soft-sided luggage case on the wheels, and wherein the cover member may be selectively opened and closed and the strap and hook member may be selectively extended from and retracted within the pocket independently of the operation of the extendable and retractable handle.

* * * * *